US006159355A

United States Patent [19]

Baudis et al.

[11] Patent Number: 6,159,355

[45] Date of Patent: Dec. 12, 2000

[54] PROCESS FOR THE ELECTROLYTIC PRODUCTION OF CYANIDE IN NITROCARBURIZING MELTS

[75] Inventors: Ulrich Baudis, Alzenau; Mandy Doose, Bargstedt; Karl-Otto Prietzel, Magdeburg, all of Germany

[73] Assignee: Houghton Durferrit GmbH, Mannheim, Germany

[21] Appl. No.: 09/354,795

[22] Filed: Jul. 16, 1999

[30] Foreign Application Priority Data

Jul. 18, 1998 [DE] Germany ..... 198 32 404

[51] Int. Cl.[7] ..... C25B 1/00; C25B 1/14

[52] U.S. Cl. ..... 205/360; 205/479

[58] Field of Search ..... 205/360, 479

[56] References Cited

U.S. PATENT DOCUMENTS 4,006,043 2/1977 Gaucher et al. ..... 148/27

*Primary Examiner*—Arun S. Phasge

*Attorney, Agent, or Firm*—Smith, Gambrell & Russell LLP

[57] ABSTRACT

In order to shorten the waiting times until the equilibrium between cyanate and cyanide is established and to limit the use of substances and products containing cyanide for nitrocarburizing in salt melts, melts containing only cyanate and optionally carbonate are electrolyzed at a current density of 4 to 100 A/dm$^2$ of electrode area to form an advantageous cyanide content of 1 to 5 wt. %.

7 Claims, 3 Drawing Sheets

PROCESS FOR THE ELECTROLYTIC PRODUCTION OF CYANIDE IN NITROCARBURIZING MELTS

INTRODUCTION AND BACKGROUND

The present invention relates to a process for the electrolytic production of cyanide in salt melts which contain cyanate and optionally carbonate and which are provided for nitrocarburizing steel.

The behavior in service of construction components is to a great extent determined by the behavior of the component surface. Nitriding or nitrocarburizing of steel has long been used on an industrial scale to increase not only resistance to wear and corrosion but also fatigue strength. Salt bath technology is of considerable significance in this connection. The principal components of these salt baths are the cyanates and carbonates of the alkali metals potassium and sodium.

Some patents, such as for example FR 9309706 or U.S. Pat. No. 5,518,605, are already known which relate to the performance of electrolysis in nitrating salt melts. However, these inventions solely relate to the improvement of the nitrocarburized surface of components. The components or feed materials themselves are here connected as anodes or cathodes. Patents concerning bath control of such melts, such as for example German 24 13 643 or German 25 29 412, by exploiting electrochemical potential measurement using the most varied electrodes are also known.

A process for the purposeful production of cyanide by electrolysis from the constituents of nitrocarburizing melts has, however, not hitherto been known. On the contrary, because of environmental and occupational health grounds, many variants of salt bath nitrocarburizing are directed towards avoiding cyanides in these melts.

The basis of the present invention, in contrast, is the recognition that a certain quantity of cyanide in the nitrocarburizing melts is highly advantageous with regard to achieving optimum serviceability (reduction of wear, corrosion protection) of the nitrided components.

It has long been standard practice to fuse nitrocarburizing melts without cyanide because the products may be transported and stored safely in this manner. Today, the fusing salts and replenishing salts conventionally used contain no cyanide at all. The cyanide advantageous for optimal nitrating is only formed over the course of a few days at operating temperature by gradual decomposition of the cyanate until an equilibrium is established in accordance with the reaction:

$$OCN^- \Leftrightarrow CN^- + \tfrac{1}{2} O_2$$

The waiting times until equilibrium is established may be shortened by subsequently adding cyanide in the form of potassium and sodium cyanide or by fusing it when the molten bath is prepared or with the replenishing salt. The greatest problem in this case is the transport, storage and handling of the products containing cyanide. Occasional attempts have also been made to increase the speed with which a cyanate/cyanide equilibrium is established by adding iron chips or introducing scrap having an elevated surface area. However, none of the above constitutes a satisfactory solution to the problem of providing a nitrating bath fused without cyanide with the increased cyanide content necessary for optimum results. At present, no alternative possibility is known for producing a sufficient quantity of cyanide in such melts in another manner.

Therefore, it is an object of the present invention to produce cyanide in nitrocarburizing melts without using substances containing cyanide, in a short period of time and without impairing subsequent nitrocarburizing of components.

SUMMARY OF THE INVENTION

The above and other objects can be achieved according to the invention by performing electrolysis in the nitrocarburizing melt containing cyanate. Both the crucible used as well as sheet electrodes made from a suitable metal or metal alloys and introduced into the bath may be used as the electrodes, as is known in the art. Electrode materials comprise corrosion resistant materials, such as in particular titanium or nickel materials as well as high-chromium steels, tantalum or graphite. The electrodes consist in each case of a metal sheet having an electrode bar of the same material attached by welding. The surface of the metal sheets need only be coarsely ground or finished. A fine finish is advantageous, but not necessary. A rectifier is used as the current source. The nitrating salt melt is electrolyzed with a current density of 4 to 100 A/dm$^2$ over a period of 1 to 12 hours at temperatures of between 450 and 650° C. This gives rise to a cyanide content of 1 to 5 wt. %, preferably of 2 to 4 wt. %.

At the beginning, the nitrocarburizing salt is fused without adding cyanidic salts. Once the cyanate content has been adjusted to 36–38%, the electrodes are suspended in the crucible, connected to the rectifier using copper leads and the desired current is established. The cyanide and cyanate content are monitored using conventional determination methods.

BRIEF DESCRIPTION OF DRAWINGS

The present invention will be further understood with reference to the accompanying drawings, wherein.

DETAILED DESCRIPTION OF INVENTION

Figure 1:
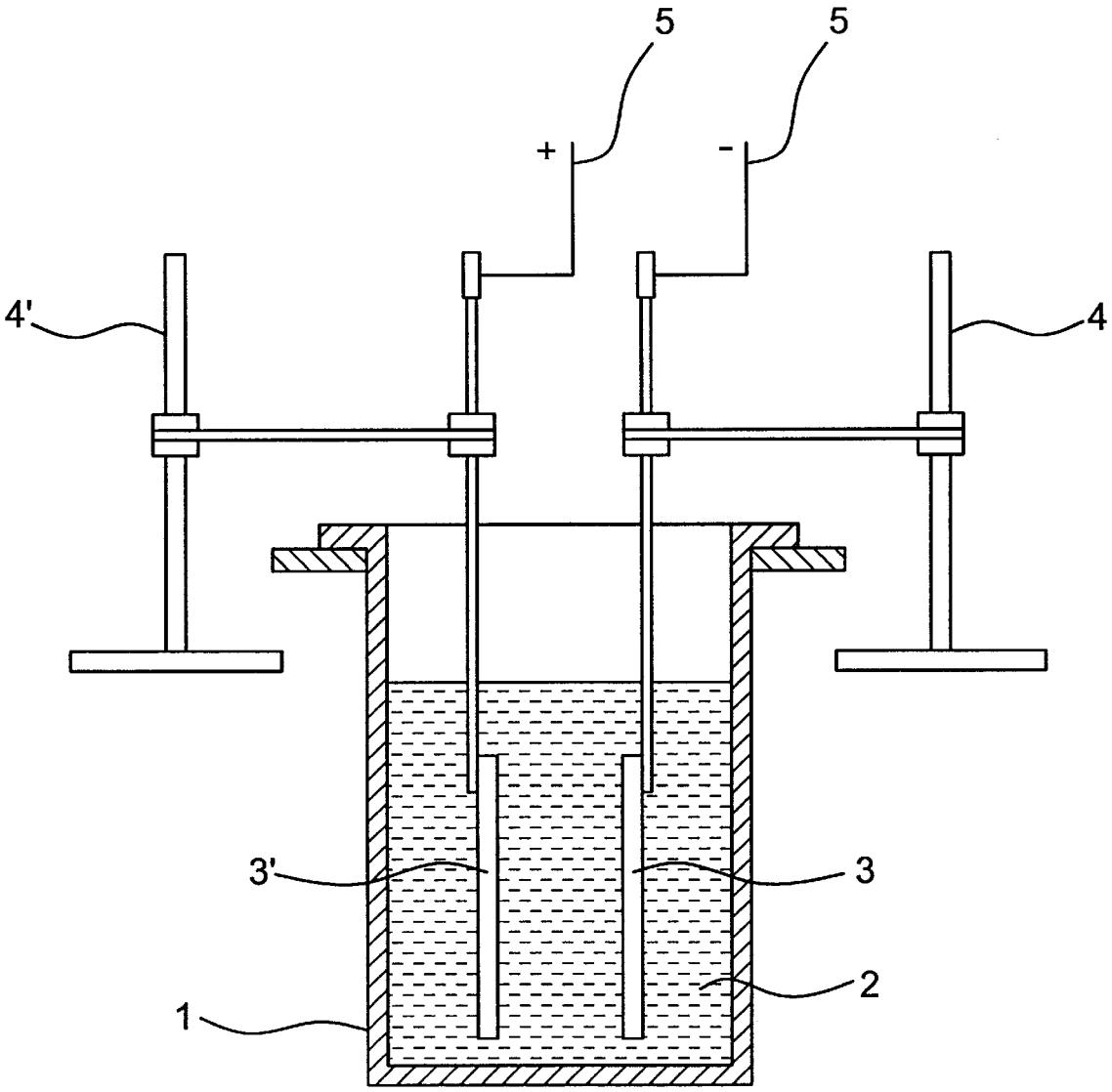
FIG. 1 is a schematic representation of the test setup used in accordance with the present invention.

The nitrocarburizing melt (2) is located in a crucible (1). Two metal sheets (3, 3') acting as electrodes, which are provided with a round bar attached by welding as power supply terminals, are suspended in the melt (2) by means of the clamps (4, 4'). Current is supplied (5) via the round bars.

The following Examples are intended to illustrate the process according to the invention in greater detail:

EXAMPLE 1

12 kg of nitrocarburizing salt were fused in an 18/30 titanium crucible (diameter 18 cm, depth 30 cm). A bath temperature of 580° C. was used. Two Inconel sheets (100×200×2 mm) were used as the electrodes, which were connected by means of 5 mm diameter copper leads to the rectifier. Once the cyanate content had been adjusted to 37.0±0.5% using a conventional commercial regenerating agent and the initial cyanide content had been checked (<0.1% or not detectable), electrolysis was begun. A current of an intensity of 70 A, corresponding to a current density of approx. 17 A/dm$^2$, was established. Electrolysis proceeded over a period of 6.5 hours. Cyanide determination revealed the results for this Example shown in Table 1.

EXAMPLE 2

12 kg of nitrocarburizing salt were again fused in an 18/30 titanium crucible. Bath temperature was likewise 580° C. The electrodes comprised a nickel sheet of dimensions 100×200×2 mm as the anode and the titanium crucible as the cathode. The electrodes were connected to the rectifier by means of 5 mm diameter copper leads. Once the cyanate content had been adjusted to desired value of 37.0±0.5% using a conventional commercial regenerating agent and the initial cyanide content had been checked (<0.1% or not detectable), electrolysis was begun. A current of an intensity of 20 A, corresponding to a current density of approx. 4.9 A/dm$^2$, relative to the anode, was established. Electrolysis proceeded over a period of 6 hours. Cyanide determination revealed the results shown in Table 1.

TABLE 1

Cyanide contents produced for Examples 1 and 2

| Test | Cyanide content produced at various testing times in % | | | | | | | | | |
|---|---|---|---|---|---|---|---|---|---|---|
| | 0 h | 0.33 h | 0.66 h | 1.0 h | 2.0 h | 3.0 h | 4.0 h | 5.0 h | 6.0 h | 6.5 h |
| Example 1 | | | | | | | | | | |
| Inconel against Inconel 17.0 A/dm$^2$ | 0.0 | 0.3 | 0.5 | 0.7 | 1.3 | 1.9 | 2.3 | 2.7 | — | 3.2 |
| Example 2 | | | | | | | | | | |
| Nickel against titanium crucible 4.9 A/dm$^2$ | 0.0 | 0.1 | 0.2 | 0.3 | 0.4 | 0.6 | 0.8 | 0.9 | 1.1 | — |

Figure 2:
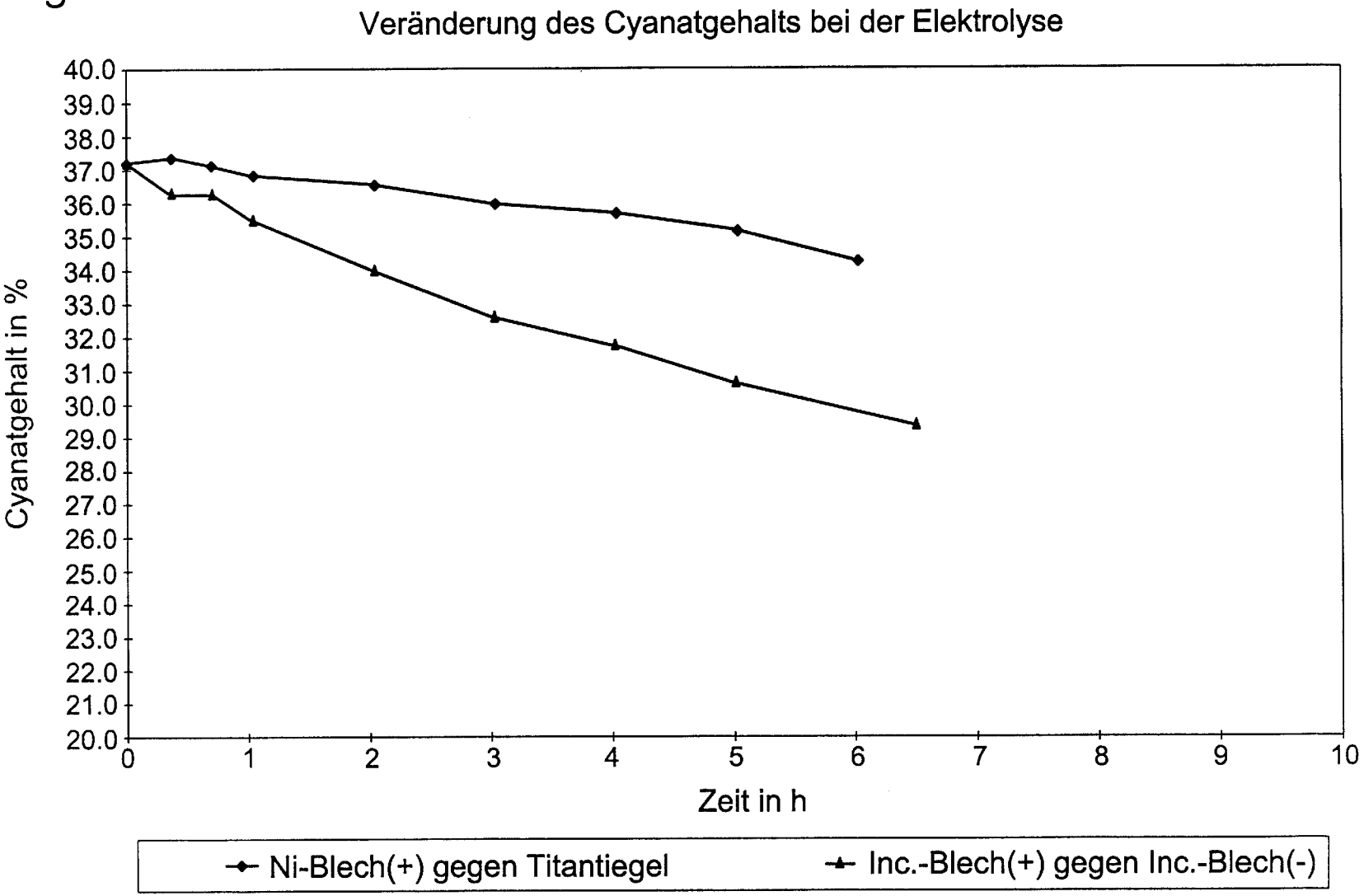
FIG. 2 is a graph showing the change in cyanate content with time.
Figure 3:
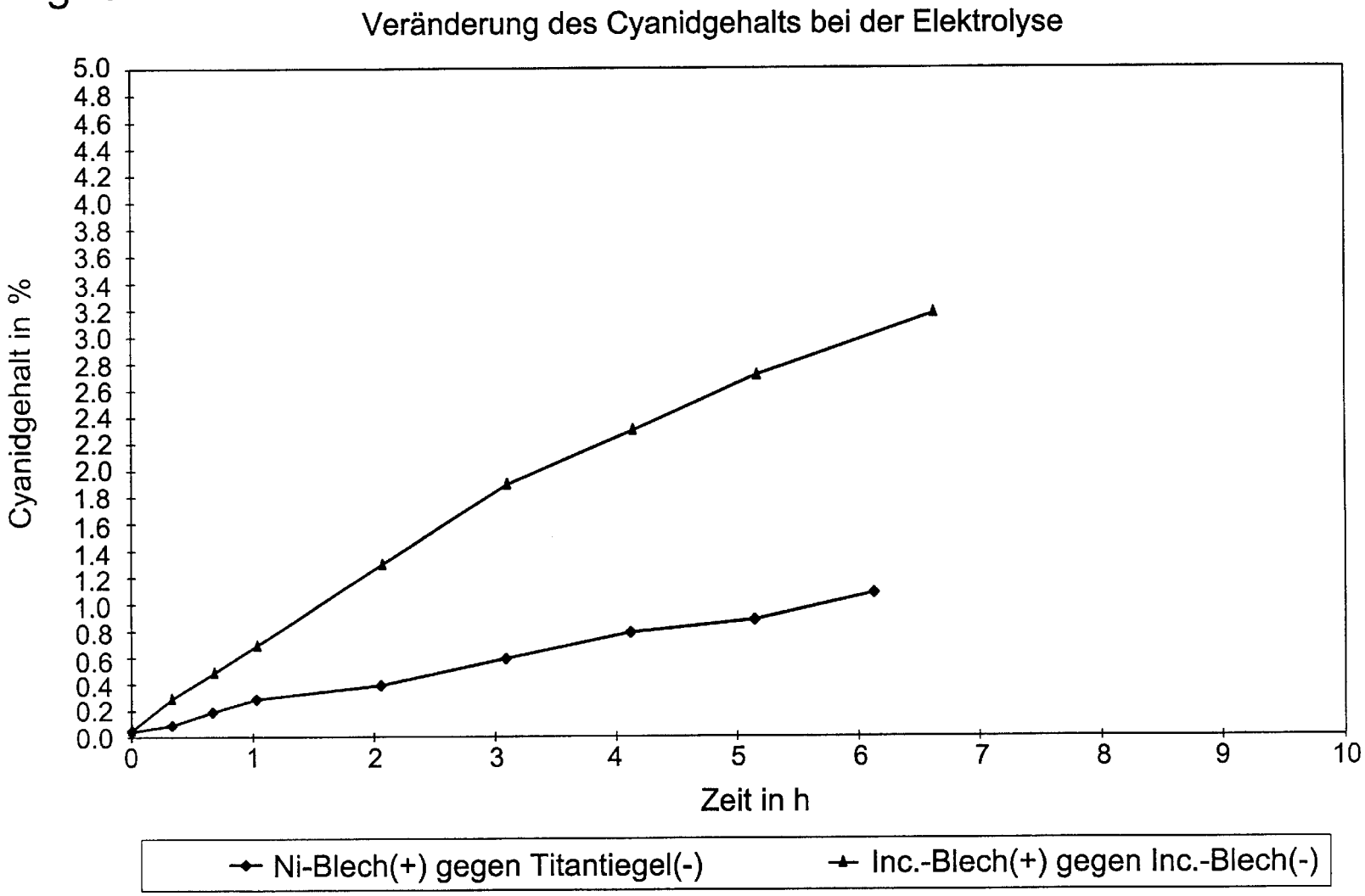
FIG. 3 is a graph showing the change in cyanide content with time.

The values are shown graphically in FIG. 2 and show the extent to which cyanide is formed in a nitrocarburizing melt when electrolysis is performed as a function of the current density used and time. The time taken to form a certain quantity of cyanide may be shortened by increasing the current density. The combination of two Inconel sheets as the anode and cathode is favorable. It is moreover typical that the introduced cyanate is reacted at approximately double the rate, as shown in FIG. 3. Cyanide is accordingly formed in favor of the cyanate. For subsequent nitrocarburizing, the melt is regenerated to the conventionally suitable cyanate content of 35–38%.

Nitrocarburization of components performed after electrolysis of components made from various materials revealed that the thickness and structure of the compound layer matched the expected values as would be obtained had the cyanide been added as the material.

It will be apparent to those skilled in the art that any suitable nitrocarburizing melt containing cyanate can be used in accordance with the invention.

Further variations and modifications of the foregoing will be apparent to those skilled in the art and are intended to be encompassed by the claims appended hereto.

German priority application 198 32 404.9, filed in Germany on Jul. 18, 1998 is relied on and incorporated herein by reference.

We claim:

1. A process for the production of cyanide in a nitrocarburizing melt containing cyanate, comprising providing a nitrocarburizing salt melt containing cyanate, electrolyzing said melt at a sufficient temperature and for a sufficient period of time to produce the desired cyanide.

2. The process according to claim 1, further comprising carrying out the electrolysis at a current density in the range from 4 to 100 A/dm$^2$ over a period of 1 to 12 hours to thereby obtain the cyanide.

3. The process according to claim 1, further comprising carrying out the electrolysis in the presence of an electrode made from a corrosion resistant material selected from the group consisting of titanium, nickel, high-chromium steel, tantalum and graphite.

4. The process according to claim 1, further comprising wherein a melt crucible acts as an electrode.

5. The process according to claim 1, wherein said temperature is between 450 and 650° C.

6. The process according to claim 1, further comprising carrying out the electrolysis under such conditions so as to produce a cyanide content of 1 to 5 wt. %.

7. The process according to claim 1, further comprising carrying out the electrolysis under such conditions so as to produce a cyanide content of 2 to 4 wt. %.

* * * * *